US005500144A

United States Patent [19]

Potini et al.

[11] Patent Number: 5,500,144

[45] Date of Patent: Mar. 19, 1996

[54] COMPOSITION FOR CLEANING AND WETTING CONTACT LENSES

[75] Inventors: Chimpiramma Potini, Methuen; Stanley J. Wrobel; Hong J. Zhang, both of Andover; Edward J. Ellis, Lynnfield, all of Mass.

[73] Assignee: Polymer Technology Corporation, Wilmington, Mass.

[21] Appl. No.: 420,915

[22] Filed: Apr. 12, 1995

Related U.S. Application Data

[63] Continuation of Ser. No. 80,427, Jun. 18, 1993, abandoned.

[51] Int. Cl.[6] ..... C11D 3/37; C11D 3/48; C11D 9/36; B08B 7/00

[52] U.S. Cl. ..... 252/174.15; 252/106; 252/173; 252/174.17; 252/544; 134/42; 514/839

[58] Field of Search ..... 252/174.15, 156, 252/173, 174.17, 542, 544, 106; 134/42; 514/839

[56] References Cited

U.S. PATENT DOCUMENTS

| | | | |
|---|---|---|---|
| 3,249,550 | 5/1966 | Metters | 252/161 |
| 3,882,036 | 5/1975 | Krezanoski | 252/106 |
| 3,954,644 | 5/1976 | Krezanoski | 252/106 |
| 4,048,122 | 9/1977 | Sibley | 252/541 |
| 4,126,587 | 11/1978 | Sibley et al. | 252/541 |
| 4,409,205 | 10/1983 | Shively | 424/78 |
| 4,529,535 | 7/1985 | Sherman | 252/106 |
| 4,613,380 | 9/1986 | Chen | 134/30 |
| 4,820,352 | 4/1989 | Riedhammer | 134/30 |
| 5,141,665 | 8/1992 | Sherman | 252/106 |

FOREIGN PATENT DOCUMENTS

| | | |
|---|---|---|
| 1034782 | 7/1966 | United Kingdom . |
| 89/11878 | 12/1989 | WIPO . |

OTHER PUBLICATIONS

Derwent Publications Ltd., AN 82–01144J & JP,A, 57168218 (Duskin Franchise KK) 16 Oct. 1982.

*Primary Examiner*—Ponnathapura Achutamurthy
*Attorney, Agent, or Firm*—Craig E. Larson; Edward W. Black; Katherine McGuire

[57] ABSTRACT

Compositions for the care of contact lenses include a silicone polymer containing an alkyleneoxide side chain.

17 Claims, No Drawings

COMPOSITION FOR CLEANING AND WETTING CONTACT LENSES

This is a continuation of application Ser. No. 08/080,427 filed on Jun. 18, 1993, now abandoned.

BACKGROUND OF THE INVENTION

This invention relates to compositions for the care of contact lenses and methods employing such compositions.

A care regimen for contact lenses involves various functions, such as regularly cleaning the lens with a contact lens solution containing a surface active agent. Rinsing of the contact lens is generally required following cleaning to remove loosened debris. Additionally, the regimen may include treatment to disinfect the lens, treatment to render the lens surface more wettable prior to insertion in the eye, or treatment to condition (e.g., lubricate or cushion) the lens surface so that the lens is more comfortable in the eye. As a further example, a contact lens wearer may need to rewet the lens during wear by administering directly in the eye a solution commonly referred to as rewetting drops.

Separate solutions may be designed for the individual segments of the care regimen. For convenience purposes, multipurpose contact lens solutions have gained popularity, i.e., solutions which can be used for several segments of the care regimen.

Multipurpose contact lens solutions which effectively clean the contact lens, and can also be used to treat the lens immediately prior to insertion of the lens in the eye, represent the more difficult multipurpose solutions to develop. Conventional surface active agents used as primary cleaning agents in the cleaning segment of the regimen, as well as various other components such as antimicrobial agents included as a preservative or disinfectant, tend to be irritating to the eye. Additionally, the surface active agents must not inhibit the wetting or conditioning function of the solution.

A principal component of the compositions of this invention is a silicone polymer containing an alkyleneoxide side chain.

U.S. Pat. No. 4,613,380 (Chen) reports tests evaluating the effectiveness of various agents for removing lipid deposits from silicone elastomer contact lenses. A silicone polymer containing an alkyleneoxy side chain (Dow Corning® 190), designated in the patent as "Surfactant 1", was employed as a comparative example in tests for effectiveness at removing lipid deposits from the contact lenses.

U.S. Pat. Nos. 4,048,122 and 4,126,587 (Sibley et al.) describe compositions for cleaning soft and silicone contact lenses which contain a polyoxyalkylene modified silicone resin and at least one fatty acid amide or nitrogen analog thereof. Although a broad class of modified silicone resins are mentioned, the described silicone resins are preferably block copolymers having the formula:

$$TSi(O(SiMe_2O)_x(C_nH_{2n}O)_yT'_3$$

wherein T is alkyl of from 1 to 3 carbon atoms, usually methyl, T' is alkyl of from 1 to 6 carbon atoms, usually 3 to 4 carbon atoms, n is an integer of from 2 to 30, and x and y are numbers within various ranges.

It will be appreciated that the silicone resin in the Chen patent was reported as not particularly effective as a primary cleaning agent for contact lens deposits. Additionally, neither the Chen patent nor the Sibley patents suggests that the compositions can wet or condition a contact lens, or that the compositions are sufficiently nonirritating for in-eye use.

SUMMARY OF THE INVENTION

In a first embodiment, this invention provides an aqueous composition for cleaning and wetting contact lenses which comprises a silicone polymer containing an alkyleneoxide side chain, and a surface active agent having cleaning activity for contact lens deposits.

The compositions provide effective cleaning activity, and are effective at wetting surfaces of the lens. The compositions achieve the desired cleaning for a wide variety of contact lens deposits but are relatively nonirritating to the eye. According to preferred embodiments, the composition is sufficiently nonirritating that contact lenses treated with the compositions can be inserted directly in the eye, i.e., without the need to rinse the composition from the lens, or the composition can be administered directly in the eye for use as a rewetting solution.

In a second embodiment, the invention provides a wetting solution for contact lenses, comprising the described silicone polymer containing an alkyleneoxide side chain.

DETAILED DESCRIPTION OF THE INVENTION

In a first embodiment, the composition of the invention is an aqueous composition which comprises a silicone polymer containing an alkyleneoxide side chain, and a surface active agent having cleaning activity for contact lens deposits.

Preferred silicone polymers are represented by the formula:

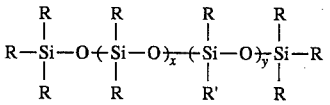

wherein:

each R is independently selected from the group consisting of $C_1$–$C_{11}$ alkyl and phenyl;

each R' is independently an alkyleneoxide containing radical;

x is 0 or an integer of at least 1, preferably 1 to 200; and y is an integer of at least 1, preferably 1 to 200.

Preferably, R' is an alkyleneoxide containing radical of the formula:

$$—R^2—O—(EO)_m—(PO)_n—H$$

wherein $R^2$ is an alkylene radical having 1 to 6 carbon atoms;

EO is the ethyleneoxide radical $—(C_2H_4O)—$;

PO is the propyleneoxide radical, preferably $—(CH_2CH(CH_3)O)—$; and each of m and n is independently 0 or an integer of at least 1, preferably m is at least 1.

Preferred silicone polymers include dimethylpolysiloxanes having at least one pendant side chain provided by the R' radical, i.e., dimethylpolysiloxanes wherein at least one methyl group attached to silicon is replaced with the alkyleneoxy pendant side chain, including several materials available under the CTFA (Cosmetic, Toiletry and Fragrance Association, Inc.) name dimethicone copolyol. Especially preferred are the alkoxylated silicone polymers available under the tradename Dow Corning® 193 from Dow Corning, Midland, Mich., USA.

The silicone polymer may be employed at about 0.001 to about 5 weight percent of the composition, preferably at about 0.002 to about 1 weight percent, with about 0.002 to about 0.1 weight percent being especially preferred.

The composition further includes at least one surface active agent having cleaning activity for contact lens deposits. This ensures that the composition has good cleaning activity. Although preferred silicone polymers such as Dow Corning 193 are surfactants, they are not particularly effective cleaning agents for removing deposits from contact lenses.

Applicants have found that the compositions of the present invention provide excellent cleaning and wetting of contact lenses. Despite the inclusion of a surface active agent having good cleaning ability, as well as various optional components tending to be irritating to the eye, the compositions exhibit minimal or no eye irritation in that the subject silicone polymer alleviates the irritation potential of the composition. Additionally, the silicone polymers contribute to the ability of the compositions to wet lenses treated with the compositions. When lenses are treated with the compositions, the hydrophobic silicone portion of these silicone polymers tend to loosely associate with the lens surface, whereby the pendant alkyleneoxy side chain extends from the lens surface to enhance wettability of the lens surface.

A wide variety of surface active agents are known in the art as a primary cleaning agent, including anionic, cationic, nonionic and amphoteric surface active agents.

Representative anionic surface active agents include sulfated and sulfonated surface active agents, and physiologically acceptable salts thereof, which provide good cleaning activity for lipids, proteins, and other contact lens deposits. Examples include sodium lauryl sulfate, sodium laureth sulfate (sodium salt of sulfated ethoxylated lauryl alcohol), ammonium laureth sulfate (ammonium salt of sulfated ethoxylated lauryl alcohol), sodium trideceth sulfate (sodium salt of sulfated ethoxylated tridecyl alcohol), sodium dodecylbenzene sulfonate, disodium lauryl or laureth sulfosuccinate (disodium salt of a lauryl or ethoxylated lauryl alcohol half ester of sulfosuccinic acid), disodium oleamido sulfosuccinates, and dioctyl sodium sulfosuccinate (sodium salt of the diester of a 2-ethylhexyl alcohol and sulfosuccinic acid).

Nonionic surface active agents having good cleaning activity include certain polyoxyethylene, polyoxypropylene block copolymer (poloxamer) surface active agents, including various surface active agents available under the tradename Pluronic from BASF Corp., e.g., Pluronic P104 or L64. (In contrast with the high-HLB PEO-containing materials, the poloxamers which may be employed as a primary cleaning agent in the compositions of this invention have an HLB value less than 18, generally about 12 to about 18.) Other representative nonionic surface active agents include: ethoxylated alkyl phenols, such as various surface active agents available under the tradenames Triton (Union Carbide, Tarrytown, N.Y., USA) and Igepal (Rhone-Poulenc, Cranbury, N.J., USA); polysorbates such as polysorbate 20, including the polysorbate surface active agents available under the tradename Tween (ICI Americas, Inc., Wilmington, Del., USA.); and alkyl glucosides and polyglucosides such as products available under the tradename Plantaren (Henkel Corp., Hoboken, N.J., USA).

The compositions may include a cationic surface active agent. Representative cationic surface active agents include triquaternary phosphate esters, such as various cationic surface active agents available from Nona Industries, Inc., Patterson, N.J., USA under the tradename Monaquat.

Additionally, the compositions may include an amphoteric surface active agent. Amphoteric surface active agents include fatty acid amide betaines, such as the cocoamidoalkyl betaines available under the tradename Tego-Betain (Goldschmidt Chemical Corp., Hopewell, Va., USA). Other amphoterics include imidazoline derivatives such as cocoamphopropionates available under the tradename Miranol (Rhone-Poulenc), and N-alkylamino acids such as lauramino propionic acid available under the tradename Mirataine (Rhone-Poulenc).

Surface active agents having cleaning activity for contact lens deposits include silicone polymers having a pendant side chain containing an ionizable group. Dimethylpolysiloxanes containing a pendant side chain having a sulfonate or sulfosuccinate radical are available under the tradenames Silube WS-100 and Silube SS-154-100 (Siltech, Inc., Norcross, Ga., USA). Dimethylpolysiloxanes containing a pendant side chain having a phosphobetaine radical are available under the tradename Silicone Phosphobetaine (Siltech, Inc.), dimethylpolysiloxanes containing a pendant side chain having an amphoteric radical are available under the tradename Siltech Amphoteric (Siltech, Inc.), and dimethylpolysiloxanes substituted with propyleneglycol betaine are available under the tradename Abil B 9950 from Goldschmidt Chemical Corp., Hopewell, Va., USA. Such silicone polymers are especially compatible in the compositions of this invention, and exhibit less irritation than many conventional cleaning agents such as the above-described anionic surface active agents.

The surface active agents having cleaning activity for contact lens deposits may be employed at about 0.001 to about 5 weight percent of the composition, preferably at about 0.005 to about 2 weight percent, with about 0.01 to about 0.1 weight percent being especially preferred.

According to preferred embodiments, the composition includes a polyethyleneoxy (PEO) containing material (in addition to any silicone polymer which contains PEO in the pendant side chain), especially a PEO-containing material having a hydrophile-lipophile balance (HLB) of at least about 18. These high-HLB PEO-containing materials are useful for further reducing the irritation potential of the surface active agent or other components in the compositions, and in some cases the PEO-containing materials may contribute to the wetting ability of the composition.

Preferred PEO-containing materials include homopolymers of polyethylene glycol or polyethyleneoxide having the high HLB value, and certain poloxamers such as materials commercially available from BASF under the tradenames Pluronic F108 and Pluronic F127. Other preferred PEO-containing materials include ethoxylated glucose derivatives, such as the ethoxylated products available under the tradename Glucam (Amerchol Corp., Edison, N.J., USA), and high HLB ethoxylated nonionic ethers of Sorbitol or glycerol, such as products available under the tradename Ethosperse, including sorbeth-20 supplied as Ethosperse SL-20 and glycereth-26 supplied as Ethosperse G-26 (Lonza Inc., Fair Lawn, N.J., USA).

When present, the PEO-containing materials may be employed at about 0.001 to about 10 weight percent, preferably at about 0.001 to about 5 weight percent.

The cleaning compositions include as necessary buffering agents for buffering or adjusting pH of the composition, and/or tonicity adjusting agents for adjusting the tonicity of the composition. Representative buffering agents include:

alkali metal salts such as potassium or sodium carbonates, acetates, borates, phosphates, citrates and hydroxides; and weak acids such as acetic, boric and phosphoric acids. Representative tonicity adjusting agents include: sodium and potassium chloride, and those materials listed as buffering agents. The tonicity agents may be employed in an amount effective to adjust the osmotic value of the final composition to a desired value. Generally, the buffering agents and/or tonicity adjusting agents may be included up to about 10 weight percent.

As mentioned, the silicone polymer contributes to the wetting ability of the composition. The composition may include as necessary a supplemental wetting agent. Representative wetting agents include: the aforementioned PEO-containing materials; cellulosic materials such as cationic cellulosic polymers, hydroxypropyl methylcellulose, hydroxyethyl cellulose and methylcellulose; polyvinyl alcohol; and polyvinyl pyrrolidone. Such additives, when present, may be used in a wide range of concentrations, generally about 0.1 to about 10 weight percent.

According to preferred embodiments, an antimicrobial agent is included in the composition in an antimicrobially effective amount, i.e., an amount which is effective to at least inhibit growth of microorganisms in the composition. Preferably, the composition can be used to disinfect a contact lens treated therewith. Various antimicrobial agents are known in the art as useful in contact lens solutions, including: chlorhexidine (1,1'-hexamethylene-bis[5-(p-chlorophenyl)biguanide]) or water soluble salts thereof, such as chlorhexidine gluconate; polyhexamethylene biguanide (a polymer of hexamethylene biguanide, also referred to as polyaminopropyl biguanide) or water-soluble salts thereof, such as the polyhexamethylene biguanide hydrochloride available under the trade name Cosmocil CQ (ICI Americas Inc.); benzalkonium chloride; and polymeric quaternary ammonium salts. When present, the antimicrobial agent may be included at 0.00001 to about 5 weight percent, depending on the specific agent.

The compositions may further include a sequestering agent (or chelating agent) which can be present up to about 2.0 weight percent. Examples of preferred sequestering agents include ethylenediaminetetraacetic acid (EDTA) and its salts, with the disodium salt (disodium edetate) being especially preferred.

The compositions are useful for hard and soft contact lenses. Hard lenses include polymethylmethacrylate lenses and rigid gas permeable (RGP) lenses formed of a silicon or a fluorosilicon polymer. Soft contact lenses include hydrophilic hydrogel lenses.

A contact lens is cleaned by exposing the lens to the cleaning composition, preferably by immersing the lens in the composition, followed by agitation, such as by rubbing the composition on the lens surface. The lens is then rinsed to remove the composition along with contaminants. The composition may also be used to rinse the lenses, or alternately, a separate solution can be used.

When the composition is used to rinse the lenses, the composition will usually adequately wet the lens surface. Due to the low irritation potential of the composition, the lens can then be inserted directly in the eye. Alternately, the cleaned lens can be subsequently treated with the composition, such as soaking the lens in the composition for sufficient time to ensure adequate wetting the lens surface. When treating lenses with the composition including an antimicrobial agent, it is preferred to soak the lenses for sufficient time to disinfect the lenses, in which case the composition is used for cleaning, disinfecting and wetting the lens. The treated lens can then be inserted directly in the eye.

A second embodiment of the invention provides a composition for wetting a contact lens comprising as an essential component the silicone polymer containing an alkyleneoxide side chain, wherein the composition is sufficiently non-irritating that contact lenses treated with the composition can be inserted directly in the eye. Alternately, the wetting composition can be applied directly in the eye as a rewetting solution. The wetting composition may include any of the components described for the cleaning and wetting composition, preferably an antimicrobial agent as a preservative or disinfectant, a buffering agent and/or a tonicity adjusting agent, and if desired, a supplemental wetting agent.

The following examples further illustrate preferred embodiments of the invention.

The compositions listed in the following tables can be prepared by the following general procedure.

The compositions can be prepared by adding the individual components to water. A representative method follows. The salts and wetting agents, such as sodium chloride, potassium chloride, disodium edetate, cellulosic components, and/or polyvinyl alcohol (PVA), are added to premeasured, heated water with mixing. This first composition is allowed to cool, filtered, and sterilized. The sodium phosphate, potassium phosphate, PEO-containing material, the silicone polymer, the surface active agents and/or glycerin are added to premeasured water with mixing and then sterilized and filtered. The antimicrobial agents are added to the remaining amount of premeasured water, and the three compositions are combined with mixing.

TABLE 1

| Component | COMP 1 | EX 1 |
|---|---|---|
| sodium chloride | 0.78 | 0.78 |
| potassium chloride | 0.056 | 0.056 |
| disodium edetate | 0.056 | 0.056 |
| PVA | 0.11 | 0.15 |
| cationic cellulosic polymer (Polymer JR-30M, Amerchol) | 0.010 | — |
| hydroxypropyl methylcellulose | 0.50 | 0.55 |
| sodium phosphate | 0.56 | 0.56 |
| potassium phosphate | 0.11 | 0.11 |
| polyethylene glycol (Polyox WSR-301, 1%, Union Carbide) | 0.10 | 0.10 |
| glycerin | 0.020 | 0.050 |
| alkoxylated silicone polymer (193, Dow Corning) | — | 0.005 |
| Polysorbate 20 (Tween-20, ICI Americas) | 0.008 | 0.010 |
| polyhexamethylene biguanide (Cosmocil CQ, 20%, ICI Americas) | 0.003 | 0.003 |
| Deionized Water (q.s. to) | 100 | 100 |
| pH | 7.3 | 7.3 |
| Osmolality (mOsm/kg water) | 354 | 370 |

The compositions of Examples 1 and Comparative Example 1 were evaluated for cleaning and wetting. efficacy. It is noted that the composition of Comparative Example 1 did not include the silicone polymer having a pendant alkyleneoxy group.

To evaluate wetting potential of the compositions, oven-dried fluorosilicone rigid, gas permeable (RGP) contact lenses were either: rubbed with the composition, inserted onto a subject's eye, and evaluated for non-wetted areas; or agitated with the composition without rubbing, inserted onto a subject's eye, and evaluated for non-wetted areas. Table 1A shows the average percent of lens area remaining non-wetted with each method of wetting (rubbing or agitation); the "Combined" column combines the trials for the two methods.

TABLE 1A

| Percent of Lens Surface Remaining Non-wetted | | | |
|---|---|---|---|
| Composition | Rubbed | Agitated | Combined |
| EX 1 | 0% | 6% | 3% |
| COMP 1 | 32% | 18% | 25% |

To evaluate cleaning efficacy, the anterior surfaces of fluorosilicone RGP contact lenses were contaminated with Vaseline® Intensive Care lotion. The contaminated lenses were either: rubbed with the composition, inserted onto a subject's eye, and evaluated for contaminated areas; or agitated with the composition without rubbing, inserted onto a subject's eye, and evaluated for contaminated areas. Table 1B shows the average percent of lens area showing lipid contamination after each method of cleaning (rubbing or agitation); the third column combines the trials for the two methods.

TABLE 1B

| Percent of Lens Surface Lipid Contamination | | | |
|---|---|---|---|
| Composition | Rubbed | Agitated | Combined |
| EX 1 | 4% | 1% | 3% |
| COMP 1 | 8% | 4% | 6% |

The compositions were also evaluated in toxicity testing. Five drops of the compositions were instilled onto the superior limbus of non-wearers of contact lenses. For subjects who are wearers of RGP lenses, lenses were rubbed with a large amount of the composition and then inserted directly on the eye. The composition of Example 1 scored better than Comparative Example 1, inducing no complaints of stinging, itching or burning.

TABLE 2

| Component | EX 2 | EX 3 | EX 4 | EX 5 | EX 6 | EX 7 |
|---|---|---|---|---|---|---|
| sodium chloride | 0.70 | 0.70 | 0.70 | 0.70 | 0.70 | 0.70 |
| potassium chloride | 0.040 | 0.040 | 0.040 | 0.040 | 0.040 | 0.040 |
| disodium edetate | 0.050 | 0.650 | 0.050 | 0.050 | 0.050 | 0.050 |
| hydroxy-propyl methyl-cellulose | 0.55 | 0.55 | 0.60 | 0.60 | 0.60 | 0.60 |
| sodium phosphate | 0.55 | 0.55 | 0.55 | 0.55 | 0.55 | 0.55 |
| potassium phosphate | 0.11 | 0.11 | 0.11 | 0.11 | 0.11 | 0.11 |
| Polyox WSR-301 (1%) | 0.10 | 0.10 | 0.10 | 0.10 | 0.10 | 0.10 |
| PVA | 1.50 | — | — | — | — | — |
| glycerin | 0.050 | 0.050 | 0.050 | 0.050 | 0.050 | 0.050 |
| alkoxylated silicone polymer (193, Dow Corning) | 0.015 | 0.015 | 0.015 | 0.015 | 0.015 | 0.015 |
| Tween-20 | 0.025 | 0.025 | — | — | — | — |
| amphoteric dimethylpoly-siloxane (Siltech-Ampho, Siltech) | — | — | 0.030 | — | — | — |
| sulfosuccinate dimethylpoly-siloxanes (Silube SS-154-00, Siltech) | — | — | — | 0.030 | — | — |
| silicone betaine (Abil B 9950, Goldschmidt) | — | — | — | — | 0.030 | — |
| phospho-betaine di-methylpoly-siloxane (Siltech Phos-phobetaine) | — | — | — | — | — | 0.030 |
| PHMB | 0.003 | 0.003 | 0.003 | 0.003 | 0.003 | 0.003 |
| Deionized Water (q.s. to) | 100 | 100 | 100 | 100 | 100 | 100 |
| pH | 7.3 | 7.3 | 7.3 | 7.3 | — | — |
| Osmolality (mOsm/kg water) | 346 | 349 | 347 | 338 | — | — |

The compositions in Table 2 were tested according to the following procedure on twenty wearers of RGP contact lenses. First, each subject's lenses were soaked in a composition for at least five minutes, and then the soaked lenses were inserted directly (i.e., without rinsing) onto the subject's eye. The amount of irritation occurring within the first 20–30 seconds after insertion was rated by the subjects using the following scale:

| |
|---|
| 0 = no irritation |
| 1 |
| 2 = very mild irritation |
| 3 |
| 4 = mild irritation |
| 5 |
| 6 = moderate irritation |
| 7 |
| 8 = severe irritation |

Additionally, five drops of each composition were then instilled directly into both eyes of each subject (one drop every 5 minutes). Again, the amount of irritation occurring within the first 20–30 minutes after instillation of each drop was rated using the above scale.

The entire procedure was repeated on separate days until each subject had tested each composition. The average rating at insertion and following instillation of each drop is listed in Table 2A.

TABLE 2A

| Average Irritation Rating | | | | | | | |
|---|---|---|---|---|---|---|---|
| | | Drop Number | | | | | Overall |
| Comp | Insertion | 1 | 2 | 3 | 4 | 5 | Average |
| EX 2 | 1.0 | 0.8 | 1.1 | 1.5 | 1.6 | 1.7 | 1.28 |
| EX 3 | 0.8 | 0.8 | 0.9 | 1.1 | 1.4 | 1.3 | 1.03 |
| EX 4 | 0.9 | 1.5 | 1.2 | 1.4 | 1.3 | 1.5 | 1.26 |
| EX 5 | 0.8 | 0.6 | 0.8 | 1.2 | 1.3 | 1.4 | 1.02 |
| EX 6 | 0.9 | 0.8 | 0.9 | 0.9 | 0.8 | 0.8 | 0.82 |
| EX 7 | 0.8 | 0.8 | 0.7 | 0.9 | 1.0 | 1.0 | 0.83 |

TABLE 3

| Component | EX 8 | EX 9 | EX 10 | EX 11 |
|---|---|---|---|---|
| sodium chloride | 0.70 | 0.70 | 0.70 | 0.70 |
| potassium chloride | 0.040 | 0.040 | 0.040 | 0.040 |
| disodium edetate | 0.050 | 0.050 | 0.050 | 0.050 |
| hydroxypropyl methylcellulose | 0.55 | 0.55 | 0.55 | 0.55 |
| sodium phosphate | 0.55 | 0.55 | 0.55 | 0.55 |
| potassium phosphate | 0.11 | 0.11 | 0.11 | 0.11 |
| Methyl gluceth-20 (Glucam E-20, Amerchol) | 0.10 | 0.10 | 0.10 | 0.10 |
| PVA | 0.15 | — | — | — |
| alkoxylated silicone polymer (193, Dow Corning) | 0.015 | 0.015 | 0.015 | 0.015 |
| Tween-20 | 0.025 | 0.020 | 0.025 | 0.020 |
| Tego-Betaine L7 (30%) | — | 0.010 | — | 0.010 |
| PHMB (20%) | 0.0025 | 0.0025 | 0.0025 | 0.0025 |
| Chlorhexidine gluconate (20%) | 0.0165 | 0.0165 | 0.0165 | 0.0165 |
| Deionized Water (qs to) | 100 | 100 | 100 | 100 |
| pH | 7.3 | 7.3 | 7.3 | 7.3 |
| Viscosity (cp at 25° C.) | 28.7 | 28.7 | 24.6 | 25.7 |
| Osmolality (mOsm/kg water) | 344 | 345 | 342 | 341 |

The compositions in Table 3, and a saline solution as a control, were tested according to the following procedure on twenty-one wearers of RGP contact lenses. First, each subject's lenses were soaked in a composition for about 8 to 10 minutes. Then, the lenses were removed from the case, additional solution was added to the back surface of the lenses, and the lenses were inserted onto the subject's eyes. After waiting periods of approximately 10 minutes, the procedure was repeated for the remaining solutions, with various compositions presented to the subjects in random order. The subjects rated irritation based on the above scale of 0 to 8. The average irritation ratings are listed in Table 3A. The Comparison of Example 11 and saline is considered statistically significant.

Additionally, the compositions were tested for insertional blur, i.e., the time required after insertion for the subject's vision to return to baseline acuity. The average time for vision to clear (after insertion), and the range of time for vision to clear for all subjects, is listed in Table 3A.

TABLE 3A

| Comp | Average Irritation | Average Time to Clear | Range of Time to Clear |
|---|---|---|---|
| Saline | 1.38 | 3 seconds | 1–9 seconds |
| EX 9 | 1.10 | 14 seconds | 4–33 seconds |
| EX 10 | 0.71 | 18 seconds | 5–42 seconds |
| EX 8 | 0.57 | 19 seconds | 3–60 seconds |
| EX-11 | 0.38 | 14 seconds | 11–60 seconds |

Additional examples of preferred multipurpose compositions suitable for cleaning and wetting contact lenses are given in Table 4.

TABLE 4

| Component | EX 12 | EX 13 | EX 14 |
|---|---|---|---|
| sodium chloride | 0.70 | 0.78 | 0.70 |
| potassium chloride | 0.040 | 0.17 | 0.040 |
| disodium edetate | 0.050 | 0.050 | 0.050 |

TABLE 4-continued

| Component | EX 12 | EX 13 | EX 14 |
|---|---|---|---|
| hydroxypropyl methylcellulose | 0.55 | 0.60 | 0.60 |
| sodium phosphate | 0.55 | 0.28 | 0.55 |
| potassium phosphate | 0.11 | 0.55 | 0.11 |
| Glucam E-20 | 0.10 | 0.10 | 0.10 |
| alkoxylated silicone polymer (193, Dow Corning) | 0.015 | 0.015 | 0.015 |
| Tween-20 | 0.025 | 0.020 | 0.020 |
| Tego-Betaine L7 (30%) | 0.010 | 0.010 | 0.010 |
| PHMB (20%) | 0.0025 | 0.0025 | 0.0025 |
| CHG (20%) | 0.0165 | 0.0165 | 0.0165 |
| Deionized Water (q.s. to) | 100 | 100 | 100 |
| pH | 7.4 | 7.3 | 7.3 |
| Viscosity (cp at 25° C.) | 30.6 | 34.6 | 33.4 |
| Osmolality (mOsm/kg water) | 363 | 351 | 341 |

Although certain preferred embodiments have been described, it is understood that the invention is not limited thereto and modifications and variations would be evident to a person of ordinary skill in the art.

We claim:

1. An aqueous composition for cleaning and wetting a contact lens comprising:

(a) silicone polymer represented by the formula:

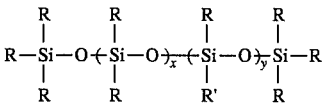

wherein:

each R is independently selected from the group consisting of $C_1$–$C_{11}$ alkyl and phenyl;

each R' is independently an alkyleneoxide containing radical;

x is 0 or an integer of at least 1; and y is an integer of at least 1; and a buffering agent or tonicity adjusting agent.

2. The composition of claim 1, wherein R' is $$—R^2—O—(EO)_m—(PO)_n—H$$

wherein $R^2$ is an alkylene radical having 1 to 6 carbon atoms;

EO is an ethyleneoxide radical;

PO is a propyleneoxide radical; and each of m and n is independently 0 or an integer of at least 1.

3. The composition of claim 1, further comprising a nonionic surface active agent having cleaning action for contact lens deposits.

4. The composition of claim 3, wherein the nonionic surface active agent comprises a polysorbate surface active agent.

5. The composition of claim 1, further comprising a cocoamidoalkyl betaine surface active agent.

6. The composition of claim 1, further comprising an antimicrobial agent.

7. The composition of claim 1, further comprising a polyethyleneoxide-containing material.

8. The composition of claim 7, wherein the polyethyleneoxide-containing material is selected from the group consisting of ethoxylated glucose derivatives, ethoxylated ethers of sorbitol, and mixtures thereof.

9. The composition of claim 1, further comprising a wetting agent selected from the group consisting of a cellulosic material, polyvinyl alcohol, polyvinyl pyrrolidone, and mixtures thereof.

10. The composition of claim 1, wherein said composition is sufficiently nonirritating for application to the eye.

11. A composition for wetting a contact lens comprising a silicone polymer represented by the formula:

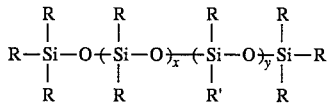

wherein:

each R is independently selected from the group consisting of $C_1$–$C_{11}$ alkyl and phenyl;

each R' is independently an alkyleneoxide containing radical;

x is 0 or an integer of at least 1; and y is an integer of at least 1; and a buffering agent or tonicity adjusting agent, wherein said composition is sufficiently nonirritating for application to the eye.

12. A method for cleaning and wetting a contact lens comprising exposing said contact lens to an aqueous composition which comprises a silicone polymer represented by the formula:

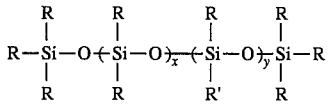

wherein;

each R is independently selected from the group consisting of $C_1$–$C_{11}$ alkyl and phenyl;

each R' is independently an alkyleneoxide containing radical:

x is 0 or an integer of at least 1; and y is an integer of at least 1; and n non-siloxane surface active agent having cleaning activity for contact lens deposits.

13. The method of claim 12, comprising:

(a) rubbing said composition against the contact lens and rinsing the contact lens to remove contaminants; and (b) subsequently treating the contact lens with said composition to wet the surface of the contact lens for insertion in the eye.

14. The method of claim 13, further comprising inserting the treated lens directly in the eye.

15. A method for cleaning, disinfecting and wetting a contact lens comprising:

(a) rubbing the contact lens with a solution comprising (i) a silicone polymer represented by the formula:

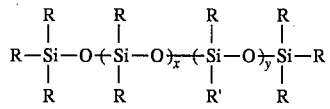

wherein:

each R is independently selected from the group consisting of $C_1$–$C_{11}$ alkyl and phenyl;

each R' is independently an alkyleneoxide containing radical;

x is 0 or an integer of at least 1; and y is an integer of at least 1; (ii) a non-siloxane surface active agent having cleaning activity for contact lens deposits, and (iii) an antimicrobially effective amount of an antimicrobial agent, and rinsing the contact lens to remove contaiminants; and (b) subsequently treating the contact lens with said composition for sufficient time to disinfect the contact lens and to wet the surface thereof for insertion in the eye.

16. A method of wetting a contact lens comprising treating the contact lens with a composition comprising a silicone polymer represented by the formula:

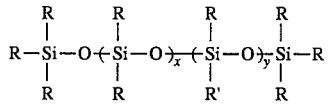

wherein:

each R is independently selected from the group consisting of $C_1$–$C_{11}$ alkyl and phenyl;

each R' is independently an alkyleneoxide containing radical;.

x is 0 or an integer of at least 1; and y is an integer of at least 1.

17. The method of claim 16, wherein the composition is applied to the contact lens while worn in the eye.

* * * * *

UNITED STATES PATENT AND TRADEMARK OFFICE

CERTIFICATE OF CORRECTION

PATENT NO. : 5,500,144

DATED : March 19, 1996

INVENTOR(S) : Chimpiramma Potini, Stanley J. Wrobel, Hong J. Zhang, Edward J. Ellis It is certified that error appears in the above-indentified patent and that said Letters Patent is hereby corrected as shown below:

In column 4, line 2, change "Nona" to -- Mona --.

In column 4, line 56, change "Sorbitol" to -- sorbitol --.

In column 7, line 44, under the heading Ex 3, change "0.650" to -- 0.050 --.

In column 9, line 41, change "Comparison" to -- comparison --.

In column 11, line 46, change "n non-siloxane" to -- a non-siloxane --.

Signed and Sealed this

First Day of October, 1996

*Attest:*

Bruce Lehman

BRUCE LEHMAN

*Attesting Officer*

*Commissioner of Patents and Trademarks*